US006138693A

United States Patent [19]

Matz

[11] Patent Number: 6,138,693

[45] Date of Patent: Oct. 31, 2000

[54] AUTOMATIC DETERGENT DISPENSER

[76] Inventor: Warren W. Matz, 13882 U.S. Hwy. 1, Juno Beach, Fla. 33408

[21] Appl. No.: 09/198,221

[22] Filed: Nov. 23, 1998

[51] Int. Cl.[7] ..... B08B 3/02

[52] U.S. Cl. ..... 134/57 D; 134/99.2; 134/100.1; 222/81

[58] Field of Search ..... 134/56 D, 57 D, 134/58 D, 100.1, 99.2; 222/81; 68/17 R, 207 R

[56] References Cited

U.S. PATENT DOCUMENTS

| | | | |
|---|---|---|---|
| 2,993,357 | 7/1961 | Smith et al. | 68/17 R |
| 3,166,096 | 1/1965 | Lang | 68/17 R |
| 4,109,829 | 8/1978 | Kuckens et al. | 222/81 |
| 5,396,914 | 3/1995 | McNair | 68/17 R |
| 5,595,223 | 1/1997 | Hayao | 222/81 |
| 5,782,109 | 7/1998 | Spriggs et al. | 68/17 R |

FOREIGN PATENT DOCUMENTS

| | | | |
|---|---|---|---|
| 823505 | 9/1969 | Canada | 222/81 |

*Primary Examiner*—Frankie L. Stinson
*Attorney, Agent, or Firm*—McHale & Slavin

[57] ABSTRACT

An automatic detergent dispenser for dishwashers allowing transfer of a liquid detergent from a disposable detergent container placed in holders along the sidewall of a dish washing chamber. The storage container includes a membrane that is pierced upon installation with a coupling tube to allow the flow of liquid detergent without the transfer of fluid between containers. Liquid detergent flows by gravity to a dispenser unit where it is stored until the wash cycle and released from the dispenser by use of an electric actuator. The detergent containers include a transparent portion to provide a visual indication of the amount of detergent contained therein.

16 Claims, 5 Drawing Sheets

AUTOMATIC DETERGENT DISPENSER

CONTINUING DATA

This is a continuation in part application of U.S. Pat. No. 5,839,454 which issued Nov. 24, 1998.

FIELD OF THE INVENTION

The invention relates to the field of dishwashers, and in particular to an automatic liquid detergent dispenser for inserting a predetermined amount of detergent into a dishwasher.

BACKGROUND OF THE INVENTION

Dishwashers have become indispensable modern day appliances. Such appliances eliminate the burden of washing and drying eating utensils by use of a chamber capable of automatically performing the cleaning task. An advantage of the dishwasher is that the chamber provides a storage location for soiled eating utensils thereby economizing the washing process for both water and detergent efficiency.

As with any cleaning process, there exists a need for adding detergent which is the mechanism for loosening embedded food particles. While conventional dishwashers include detergent dispensers for inserting the proper amount of detergent at the proper time, the amount to be dispensed is determined by the operator of the dishwasher. The dispensers may include markings to direct the operator to the preferred amount of detergent but such markings are hard to see, inaccurate, and nearly impossible to level off the detergent to the desired level marking. Most users therefore, fill the dispenser to the top and even overfill each time. When liquid detergent is used, it must be added right before the dish washing cycle begins as liquid detergent has a tendency to leak out of the holding container lessening the effectiveness of the cleaning cycle. When granular detergent is used it must be added just before the dish washing cycle begins, or the granular detergent tends to cake in the dispenser and does not thoroughly dissolve until sometime into the rinse cycle.

Most importantly, adding of the detergent is easily forgotten when numerous members of a household are adding utensils to the dishwasher chamber. The individual who turns on the dishwasher may forget to add the necessary detergent thinking another performed the chore. In this situation the dishwasher goes through a complete cycle without any cleaning what-so-ever, only a rinsing. If the individual whose task it is to unload the dishwasher does not observe that the dishwasher went without detergent, the utensils, dishes will be put away unclean, possibly with harmful bacterial contamination on every item in the dishwasher.

Conventional detergent dispensers also present a problem most evident to those attempting to economically purchase liquid detergent in bulk quantity. The lifting of a large container of fluid can cause injury to the elderly or individual who might be slightly physically impaired. Further, the manual filling of door mounted dispensers requires the individual to balance the large container while attempting to fill a very small holding dispenser.

The inefficiency of the detergent filling process leads to a waste of detergent sending excess detergent to the drain causing a waste of money and placing more burdens on the municipal or septic treatment areas. In addition, excess detergent can damage glassware and fragile utensils and some detergents are caustic to those individuals having tender skin. Thus, the amount of detergent used is critical to promote proper operation and efficiency of the dishwasher.

U.S. Pat. No. 3,370,597 discloses a dish washing machine with a liquid sanitizer dispenser. The dispenser includes a motor driven pump and spray device incorporating a gravity fed pump with an integrated solenoid and dispensing valve. The main purpose of the device is to inject chlorine into the dishwasher for disinfection of the eating utensils. Cycling of the injection system is independent of the detergent dispensing cycle.

U.S. Pat. No. 3,749,288 discloses a liquid dispenser integrated into a wall of a dishwasher for inserting a wetting agent to assist the washing cycle.

U.S. Pat. No. 5,282,901 discloses a removable liquid dispenser for inserting detergent into an industrial dish washing machine. A probe is placed into the wash chamber for monitoring the conductivity of the wash water. The wash chamber maintains a volume of water wherein the conductivity provides a relationship to water quality. The device is complicated and not suited for residential purposes, nor does it have the ability to monitor the amount of liquid detergent left in the supply container, or stop the machine from going through a wash cycle when there is no detergent available.

Thus, what is lacking in the art is a detergent dispenser having the ability to automatically dispense liquid detergent from an integrated reservoir. The dispenser needing a means for monitoring the amount of detergent stored and quantity dispensed.

SUMMARY OF THE INVENTION

The instant invention is an apparatus for holding a large quantity of detergent in a conventional dishwasher and includes a means for dispensing a predetermined amount of the detergent upon demand. In a preferred embodiment, the apparatus consists of a disposable liquid detergent container mounted along an inner wall of the dishwasher. The container includes a pierceable membrane to allow installation with opening of the container.

The liquid detergent is drawn from the container by gravity into a dispensing chamber. The dispensing chamber has a solenoid that operates during the soap dispensing cycle of the dishwasher and is triggered by the same electrical impulse that triggers the conventionally activated door mounted detergent dispenser.

Embodiments of the detergent container include a housing slidably insertable into a pair of holding clamps, wherein the pierceable membrane is along a leading edge of the housing and used for coupling to a detergent collecting tube. The edge of the container is transparent and allows visual inspection of the amount of detergent maintained within the container.

A second embodiment of the detergent container employs the pierceable membrane along the bottom of the container providing an upright mounting position while accomplishing the same purpose. A third embodiment of the detergent holder employs a shell for housing a soft sided plastic bag which holds the liquid detergent. The plastic bag lessons the cost of manufacturing and like the previous embodiments can be made of a recyclable plastic.

The dispensing solenoid consists of an electromagnet that operates a retractable seal holding a predetermined amount of detergent in a dispensing chamber. The dispensing chamber volume is readily adjustable or can be preset from the manufacture. The dispensing chamber includes a reservoir wall that can be easily removed for cleaning.

Thus, an objective of the instant invention is to provide an automatic liquid detergent dispenser for use in combination with a new or existing dishwasher, providing efficiency and detergent dispersion.

Still another objective of the instant invention is to teach a gravity feed detergent dispenser.

Yet still another objective of the instant invention is to simplify the placement of detergent in a dishwasher so as to eliminate the need for insertion of dishwasher detergent during every single washing for purposes of convenience as well as eliminate the possibility of consumer forgetfulness.

Another objective of the instant invention is to disclose an automatic detergent dispenser capable of utilizing disposable cartridge-like detergent containers with a visual indication of the container quantity.

Yet, still another objective of the instant invention is to provide disposable detergent containers for holding a large volume of detergent, said container having pierceable membranes to allow for ease of installation while reducing or eliminating the need for access caps.

Yet still another objective of the instant invention is to disclose a solenoid actuated dispensing chamber having provisions cleaning, adjusting, and repairing.

Yet still another objective of the instant invention is to disclose storage container that may be placed either inside or outside of the dish washing chamber.

Other objectives and advantages of this invention will become apparent from the following description taken in conjunction with the accompanying drawings wherein are set forth certain embodiments of this invention. The drawings constitute a part of this specification and include exemplary embodiments of the present invention.

BRIEF DESCRIPTION OF THE DRAWINGS

FIG. 2(*a*) is a partial front view of FIG. 2;

FIG. 3(*a*) is a front view of FIG. 3;

DETAILED DESCRIPTION OF THE PREFERRED EMBODIMENT

Although the present invention is herein described in terms of a basic embodiment, it will be readily apparent to those skilled in this art that various modifications, rearrangements, and substitutions can be made without departing from the spirit of the invention. The scope of the present invention is thus only limited by the claims appended hereto.

Figure 1:
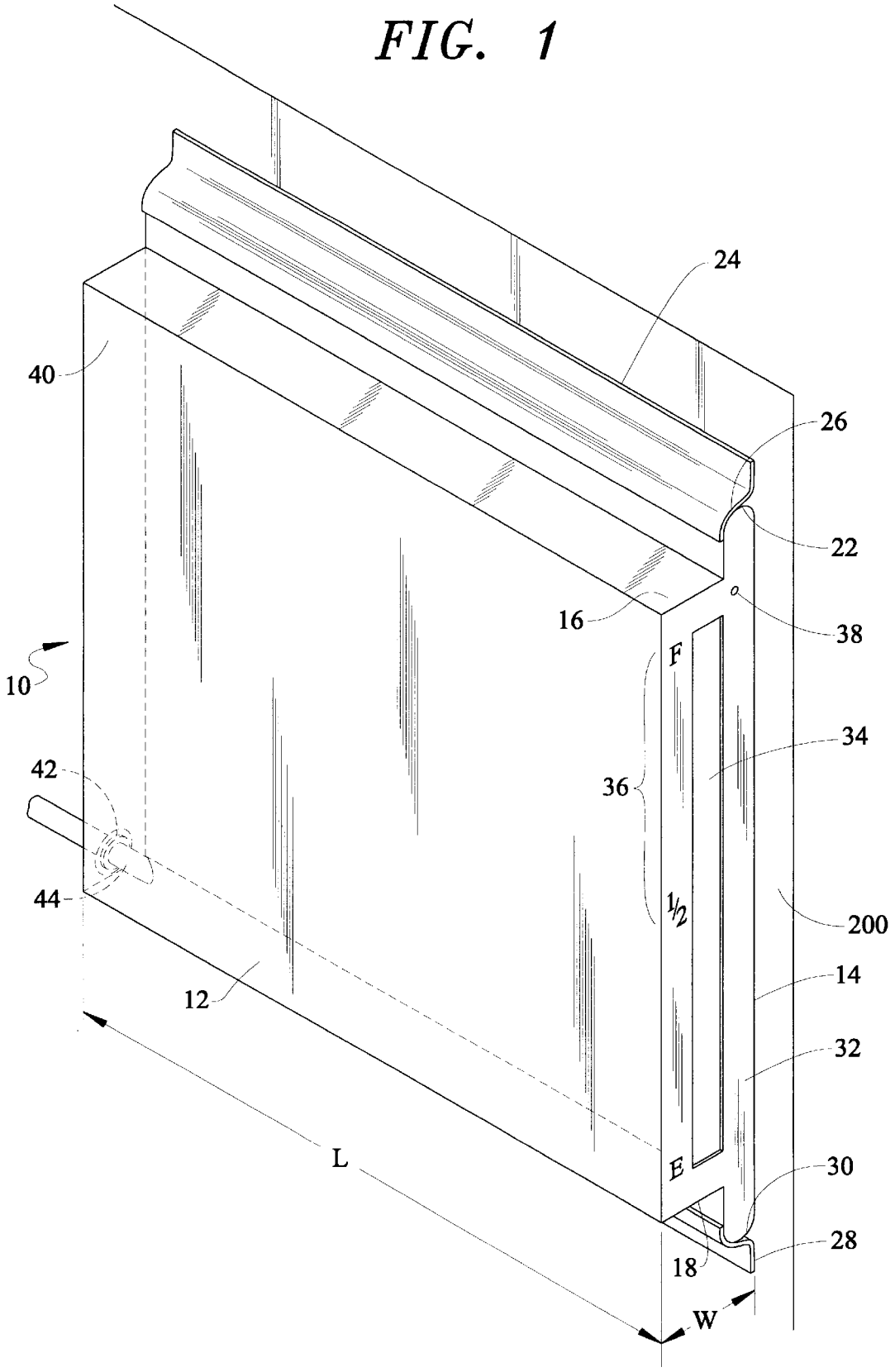
FIG. 1 is a perspective view of a horizontally disposed detergent container.

Referring now to FIG. 1, set forth is a first embodiment of the detergent container 10, which consists of a single housing defined by a front wall 12, back wall 14, top wall 16, and a bottom wall 18. The back wall 14 is positionable against the inner side surface 200 of a dishwasher. As illustrated, the container has a width W sized to avoid interference with the operation of items placed within the dishwasher. An elongated length L may be varied to allow placement between the storage racks of a conventional two rack dishwasher.

The top surface 16 of the container includes an engagement tab 22, which is operatively associated with holder bracket 24. Engagement tab 22 is slidable along the length of the bracket 24 which is formed into a curvature 26 along the length of the bracket 24. Similarly, a bottom bracket 28 is operatively associated with an insertion tab 30 projecting from the bottom wall 18 to juxtaposition surface 14 along inner surface 200 of the dishwasher.

Edge 32 of the dispenser includes a transparent window 34 to allow visual depiction of the amount of detergent alongside level indicia 36 markings. A vent 38 can be membrane for puncturing or have a removable adhesive cover placed thereover to allow free flow through the container once properly installed. The leading wall 40 includes a soft membrane 42 positioned along the lower edge to accept insertion of piercing line 44 during installation. In this manner, container 12 is slid between holders 24 and 28 along the side wall 200 wherein the membrane 42 is automatically pierced by the sharpened edge of transfer tube 44 during the installation step. The transfer tube is hollow and provides a transfer of detergent between the container and the dispensing chamber.

Figure 2A:
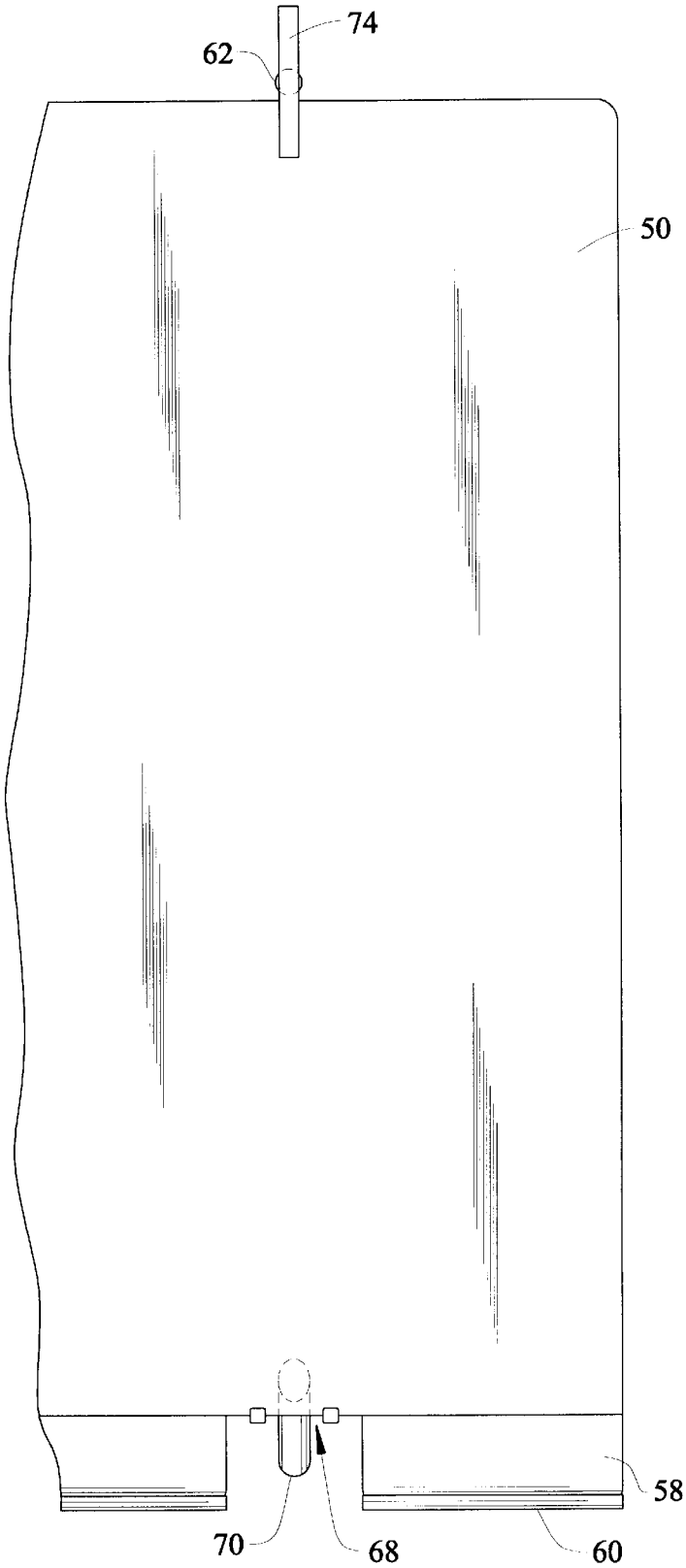
FIG. 2 is an end view of a vertically disposed detergent container.
Figure 2:
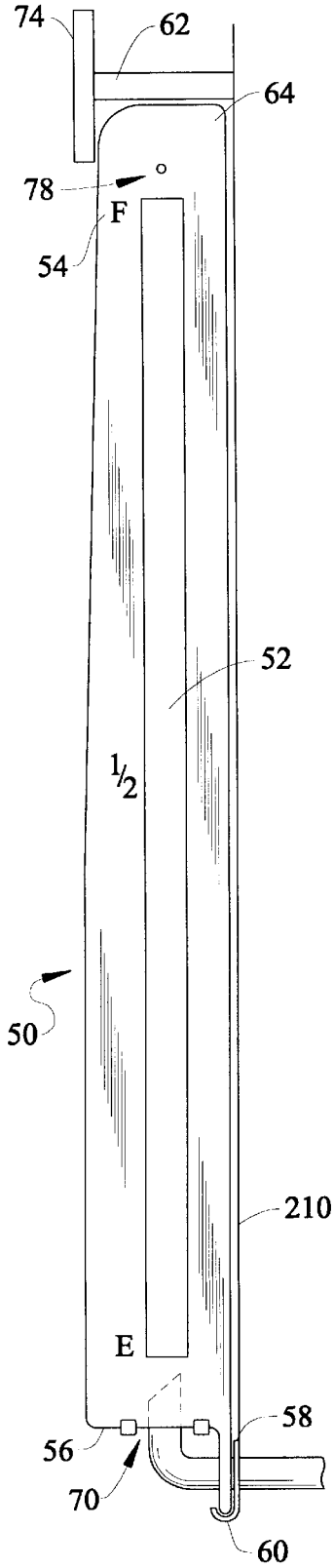

Now referring to FIGS. 2 and 2(*a*), set forth is a second embodiment of the detergent container depicted by numeral 50. In this embodiment the detergent container is mounted in a vertical orientation while the transparent window 52 with indicia 54 remains along the side of the container to provide visual indication of the detergent level. In this embodiment the lower surface 56 includes an engagement tab 58 which is insertable into a U-shaped channel 60 positionable along the side wall 210 of the dishwasher. A latching mechanism 62 is located along the upper portion 64 of the container 50. In operation, the container 50 is secured to the side wall 210 by placement of the insertion tab 58 into channel 60 wherein membrane 68 is pierced by rigid fluid pipe 70. The container is then pivoted upwardly against the side wall and is maintained against the side wall by use of latching mechanism 62. The latch is a simple rotatable lever having handle 76 which is rotatable and positionable along the frontal surface of the container 50. Similar to the first embodiment, a vent 78 is provided to allow ease of flow of liquid detergent from the container into and through the fluid coupling pipe 70.

Figure 3A:
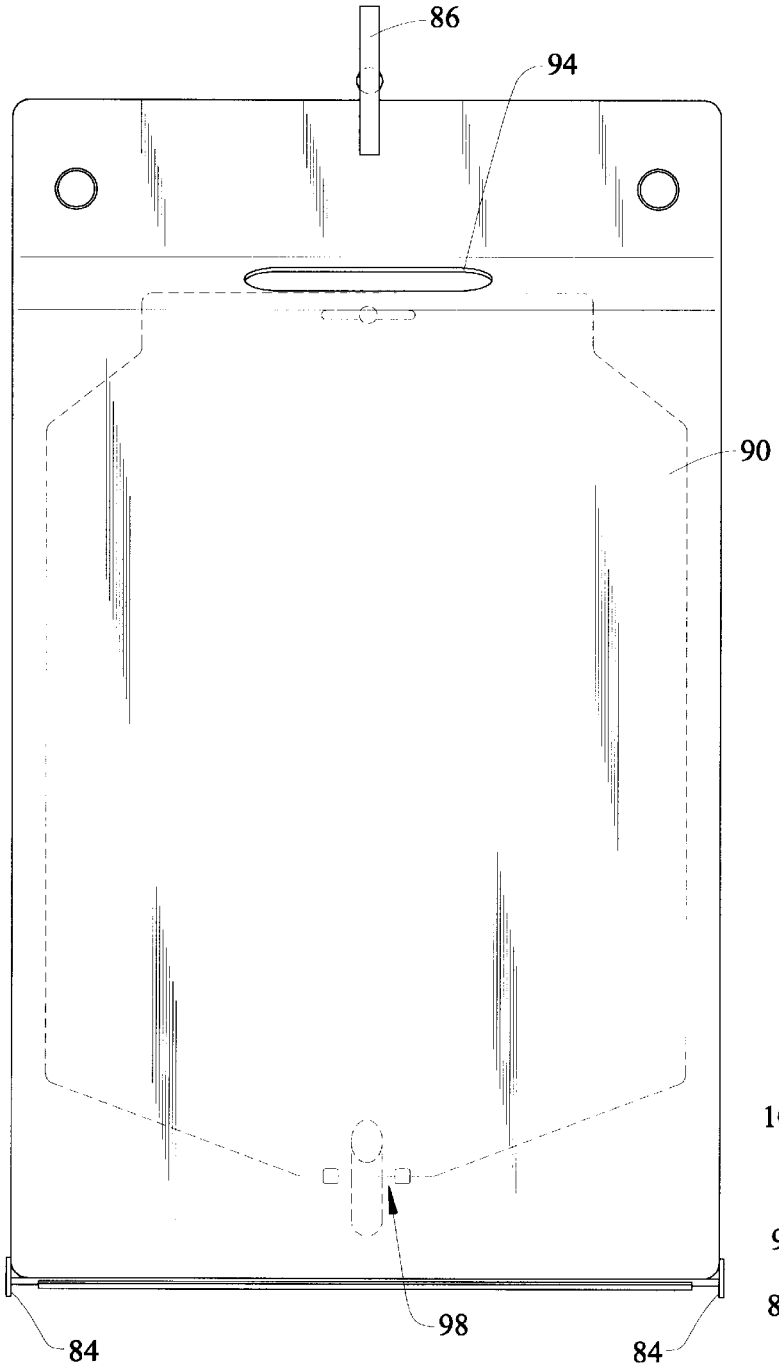
FIG. 3 is a cross-sectional end view of a detergent dispenser having a thin wall detergent bag.
Figure 3:
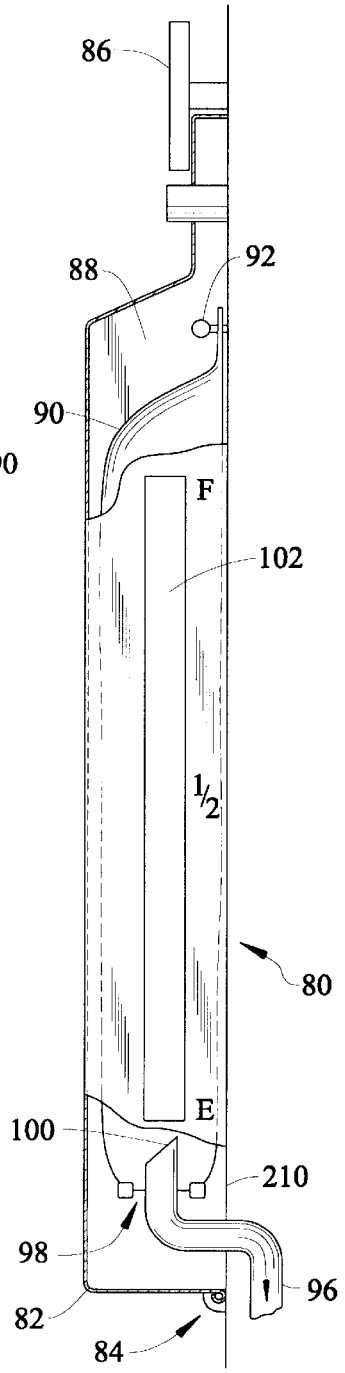

Now referring to FIG. 3 and 3(*a*), set forth is a third embodiment of the instant invention. The detergent container 80 includes a rigid outer casing 82 having hinges 84 secured to the side wall 210 of a dishwasher. A latching mechanism 86 allows rigid cover 82 to pivot along hinges 84 upon rotation of the latch 86 to allow access to an interior chamber 88. The interior chamber 88 is sized to accommodate a flexible and disposable detergent bag 90 that is held in position by the use of hangar 92 insertable through hand hold 94. The hangar 92 maintains the bag in an upright position allowing for the flow of detergent through coupling pipe 96. The bottom of the flexible bag 90 includes a membrane 98 which is punctured by the sharpened end 100 of coupling pipe 96. As with the first embodiments, a side wall of the housing 82 includes a transparent window portion 102 for use in viewing the amount of detergent that remains within the container.

Figure 4:
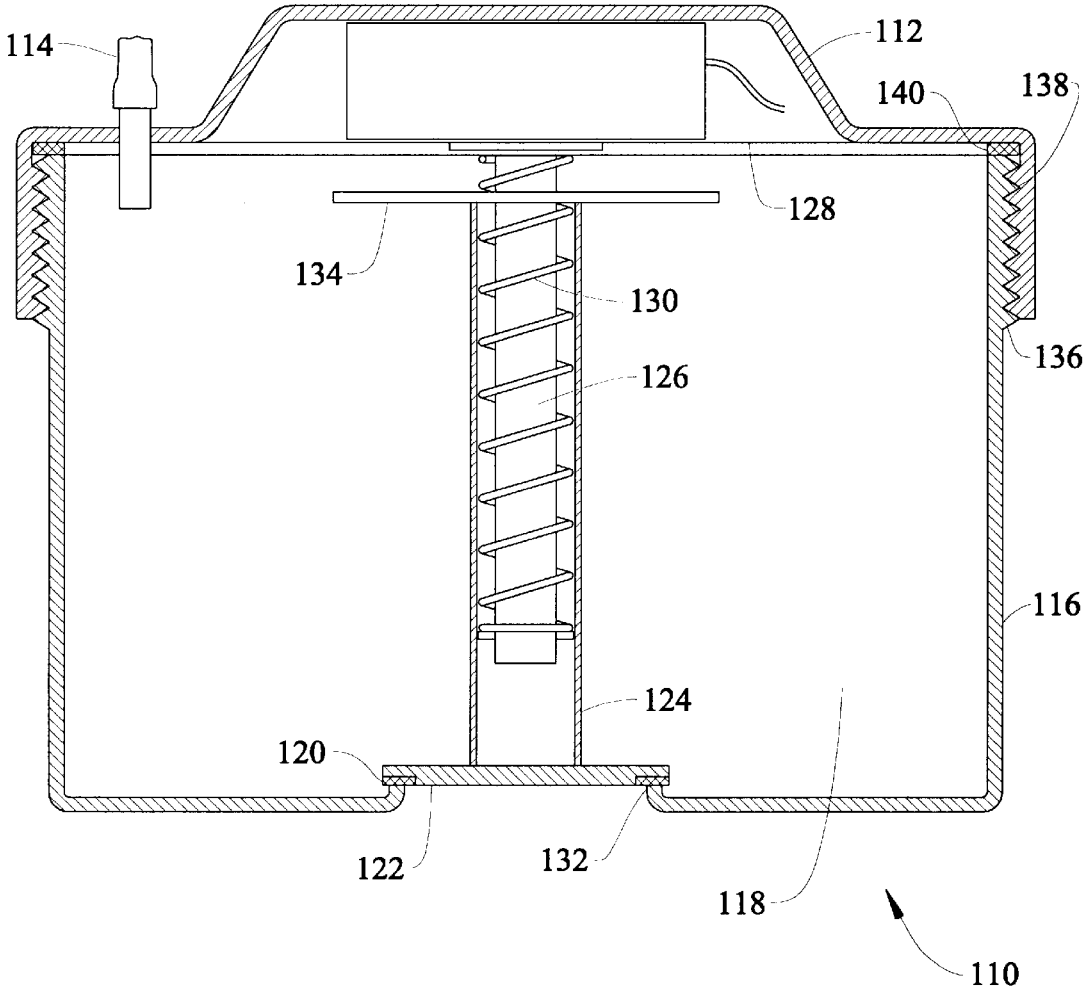
FIG. 4 is a cross-sectional side view of a detergent dispenser.

Now referring to FIG. 4, illustrated is a detergent dispenser that is coupled to the detergent container. The detergent dispenser consists of a base frame 112 which is securable to the side wall of the dishwasher with an opening for insertion of the fluid coupling pipe 114 which allows for the fluid detergent transfer from the detergent container to a measuring bowl 116. The measuring bowl allows for a predetermined amount of detergent to be placed therein through gravity transfer and a gravity disbursement of the detergent placed within the cavity 118 past seal mechanism 120. The sealing mechanism may consist of a deformable end piece 122 or soft seal which is coupled to a shaft 124 and movable along pinon 126. The pinon is mounted to the upper surface 128 of the structure with a spring 130 biased against the shaft 124 and against the bottom of the receptacle 110 along opening 132. The upper portion 134 of the shaft includes a piece of metal wherein operation causes a solenoid 136 to energize creating a magnetic field so as to draw the upper portion 134 upward providing a space between sealing end 122 and opening 132. The detergent placed within the receptacle 118 may then flow through the opening and into the dishwasher. The receptacle 116 may be threaded along an upper edge 136 and operatively associated with threads 138 formed integral with the housing 112. Seal 140 prevents a loss of detergent as well as inhibit detergent solidifying within the threaded portion.

Figure 5:
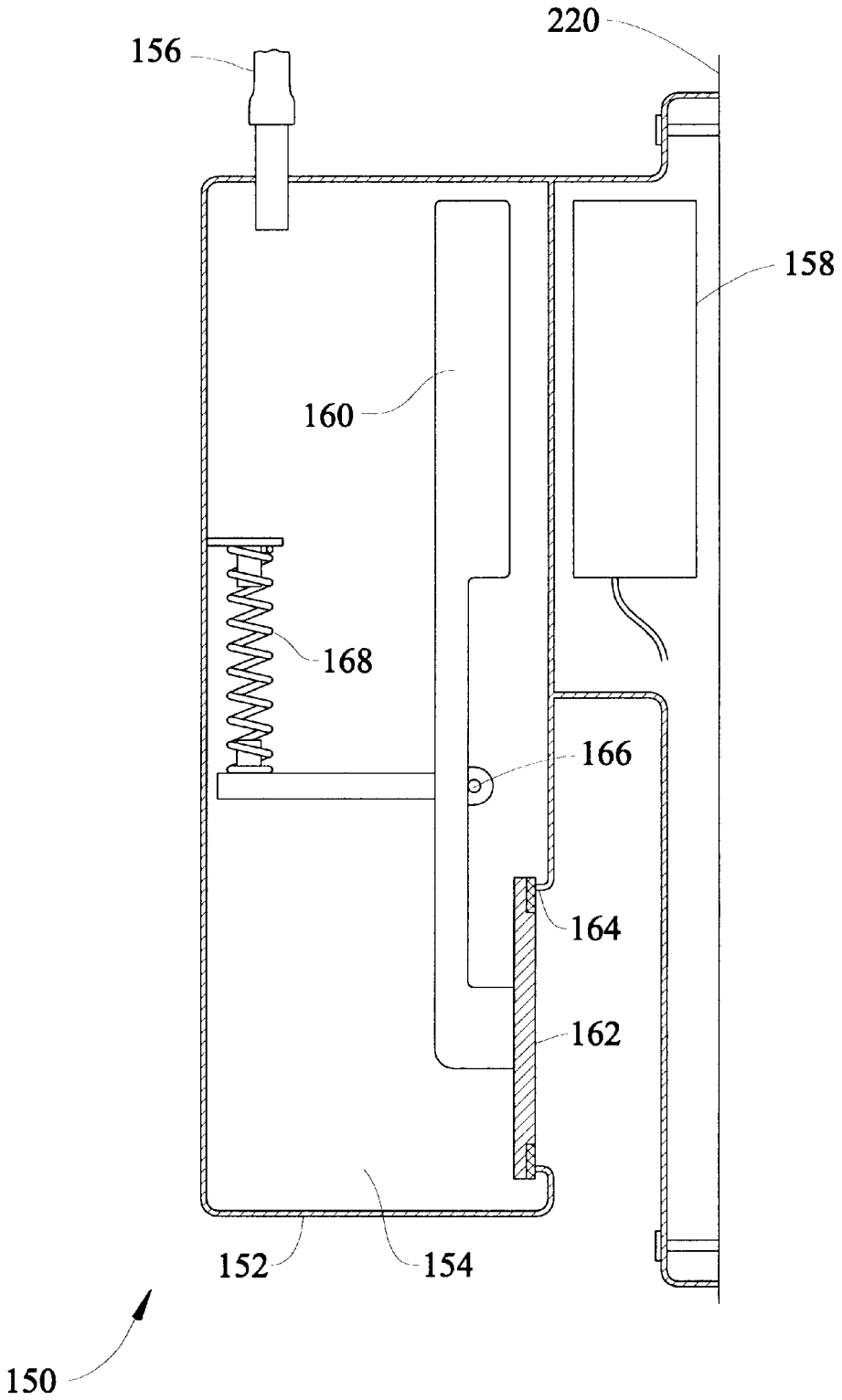
FIG. 5 is a cross-sectional side view of a detergent dispenser of a second embodiment.

Referring now to FIG. 5, set forth is a second embodiment of the detergent dispenser 150 which is securable to the side wall 220 of a dishwasher. The dispenser includes a dispensing shell 152 having a cavity 154 for receipt of detergent therein through flow coupling tube 156. Upon filling of the cavity with detergent, when the dishwasher requires detergent during a wash cycle, solenoid 158 is energized so as to cause metal including surface 160 to draw against the formed magnet thereby opening seal 162 allowing detergent to flow through opening 164. The actuating lever 160 and opening seal 162 rotate at pivot point 166 and is spring biased 168 to maintain seal 162 tightly against opening 164, thereby preventing premature detergent discharge or washout due to a backflow of water during the rinsing cycle.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. In combination with a dishwasher having a washing chamber and internal spray mechanism for cleansing of utensils placed within the chamber, an automatic detergent dispenser comprising:

a storage means for holding a large volume of liquid detergent;

a dispensing means electrically coupled to said dishwasher for dispensing a predetermined amount of liquid detergent;

a coupling tube fluidly coupling said storage means to said dispensing means, said storage means including a pierceable membrane operatively associated with said coupling tube;

whereby liquid is drawn from said storage means by gravity into said dispenser.

2. The combination according to claim 1 wherein said storage means is further defined as a rigid container having an upper insertion tab, a lower insertion tab, and the membrane located along a side edge thereof, said tabs slidably along an upper and lower bracket mounted bracket for securing said rigid container along a side wall of said dishwasher.

3. The combination according to claim 1 wherein said storage means is further defined as a rigid container having two lower insertion tabs with the membrane located therebetween, and a means for securing an upper portion of said container to an inner wall of said dishwasher.

4. The combination according to claim 1 wherein said storage means is disposable.

5. The combination according to claim 1 wherein said housing is recyclable.

6. The combination according claim 1 wherein said housing includes a chamber for placement of a thin, flexible bag of liquid detergent.

7. The combination according to claim 1 wherein said dispenser includes a gravity filled housing electrically coupled to the dispensing cycle of the dishwasher.

8. The combination according to claim 1 wherein said storage means includes a means for venting.

9. The combination according to claim 1 wherein said storage means includes a transparent window to provide a visual indicator of the amount of detergent stored therein.

10. The combination according to claim 9 wherein said transparent window includes indicia positioned along a side of said window to assist in quantity determination.

11. The combination according to claim 1 wherein said dispensing means includes:

a frame secured within said washing chamber;

a bowl member in fluid communication with said coupling tube, said bowl member having an internal cavity and being adapted for removable attachment to said frame member; and a release mechanism adapted to selectively provide an outlet opening within said bowl member, said release mechanism including a spring-biased piston having a magnetically attracted member at a first end and a sealing member at an opposite second end, said piston moving linearly between a release orientation upon activation of said solenoid and a sealing orientation upon deactivation of said solenoid.

12. The combination according to claim 1 wherein said dispensing means includes:

housing including a cavity in fluid communication with said coupling tube, said housing being secured within said washing chamber; and a release mechanism adapted to selectively provide an outlet opening within said housing, said release mechanism including a spring-biased pivot arm having a magnetically attracted member at a first end and a sealing member at an opposite second end, said pivot arm rotating between a release orientation upon activation of said solenoid and a sealing orientation upon deactivation of said solenoid.

13. In combination with a dishwasher having a wishing chamber and internal spray mechanism for cleansing of utensils placed within the chamber, an automatic detergent dispenser comprising:

a vented recyclable storage means for holding a large volume of liquid detergent, said storage means having a pierceable membrane on one end and a transparent window along another end;

a dispensing means electrically coupled to said dishwasher for dispensing a predetermined amount of liquid detergent; and a coupling tube fluidly coupling said storage means to said dispensing means;

whereby said storage means is positioned within said dish washing chamber and liquid is drawn from said storage means by gravity into said dispenser.

14. The combination according to claim 13 wherein said storage means is further defined as a rigid container having an upper insertion tab, a lower insertion tab, and the membrane located along a side edge thereof, said tabs slidably along an upper and lower bracket mounted bracket for securing said rigid container along a side wall of said dishwasher.

15. The combination according to claim 13 wherein said storage means is further defined as a rigid container having two lower insertion tabs with the membrane located therebetween, and a means for securing an upper portion of said container to an inner wall of said dishwasher.

16. The combination according claim 13 wherein said housing includes a chamber for placement of a thin, flexible bag of liquid detergent.

* * * * *